US006775490B2

(12) United States Patent
Eck et al.

(10) Patent No.: US 6,775,490 B2
(45) Date of Patent: Aug. 10, 2004

(54) ELECTROSTATOGRAPHIC REPRODUCTION METHOD AND APPARATUS WITH IMPROVED START-UP TO SUBSTANTIALLY PREVENT TRANSFER ROLLER CONTAMINATION

(75) Inventors: Edward M. Eck, Lima, NY (US); Kenneth P. Friedrich, Honeoye, NY (US); Philip A. Stern, Rochester, NY (US); James A. Zimmer, Jr., Rochester, NY (US)

(73) Assignee: NexPress Digital LLC, Rochester, NY (US)

( * ) Notice: Subject to any disclaimer, the term of this patent is extended or adjusted under 35 U.S.C. 154(b) by 0 days.

(21) Appl. No.: 10/235,752

(22) Filed: Sep. 5, 2002

(65) Prior Publication Data

US 2003/0044191 A1 Mar. 6, 2003

Related U.S. Application Data

(60) Provisional application No. 60/317,675, filed on Sep. 5, 2001.

(51) Int. Cl.[7] ..... G03G 15/16
(52) U.S. Cl. ..... 399/66; 399/313
(58) Field of Search ..... 399/66, 55, 121, 399/301, 101; 347/142

(56) References Cited

U.S. PATENT DOCUMENTS 5,101,238 A 3/1992 Creveling et al.
5,491,544 A 2/1996 Kenin et al.
5,828,927 A * 10/1998 Yoo et al. ..... 399/66
5,999,760 A * 12/1999 Suzuki et al. ..... 399/66
6,014,158 A * 1/2000 Ziegelmuller et al. ..... 347/142
6,151,461 A * 11/2000 Satoh et al. ..... 399/66

OTHER PUBLICATIONS

Service documentation for Heidelberg Digimaster 9110, Publication Date: Jan., 2000.

* cited by examiner

*Primary Examiner*—Arthur T. Grimley
*Assistant Examiner*—Ryan Gleitz

(57) ABSTRACT

An electrostatographic reproduction apparatus having a transfer assembly, including an electrically biased transfer roller in nip relation with a dielectric support member, for effecting transfer of a pigmented marking particle image from an image area of a dielectric support member to a receiver member in transfer relation with the dielectric support member in the transfer nip, a mechanism for cleaning the transfer roller including a control for the electrical bias on the transfer roller. The electrical bias control has a power supply generating an electrical output, of a settable polarity, connected to the transfer roller for applying an electrical bias of a set polarity thereto. A mechanism disables the power supply for a period of time during a start-up phase of reproduction so as to prevent transfer of residual marking particles from the dielectric support member to the transfer roller.

8 Claims, 5 Drawing Sheets

ELECTROSTATOGRAPHIC REPRODUCTION METHOD AND APPARATUS WITH IMPROVED START-UP TO SUBSTANTIALLY PREVENT TRANSFER ROLLER CONTAMINATION

RELATED APPLICATIONS

Applicants hereby claim priority under 35 U.S.C. §119(e) to provisional U.S. patent application Ser. No. 60/317,675, filed on Sep. 5, 2001, and incorporated herein by reference.

BACKGROUND OF THE INVENTION

The present invention relates in general to reproduction apparatus utilizing an electrically biased roller for transferring a marking particle image from an image bearing dielectric support member to a receiver member, and more particularly to control for the electrical bias of the reproduction apparatus transfer roller in order to optimize cleaning thereof, particularly during a start-up phase of reproduction.

In typical commercial electrostatographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern at a developing station to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

Application of the electric field to effect marking particle image transfer may be accomplished by ion emission from a corona charger onto the receiver member while in contact with the dielectric support member. Alternatively, an electrically biased roller, urging the receiver member against the dielectric support member, has been used to cause the marking particles on the dielectric support member to move to the receiver members. That is, the transfer roller is electrically biased so as to charge the receiver member with the opposite polarity to that of the marking particles. Roller transfer apparatus offer certain advantages over corona transfer apparatus in that the roller transfer apparatus substantially eliminate defects in the transferred image due to paper cockle or marking particle flakes. This result stems from the fact that the pressure of the roller urging the receiver member against the dielectric support member is remarkably efficient in providing intimate uniform contact therebetween.

However, during operation of roller transfer apparatus, background marking particles, or marking particles outside the area of the receiver member may be picked up by the transfer roller resulting in contamination of the roller. Transfer roller contamination may eventually result in contamination of the backside of receiver members passing between the transfer roller and the dielectric support member. The backside of the receiver members are those sides facing the transfer roller surface. In order to minimize transfer roller contamination, a cleaning subsystem may be added to the roller transfer assembly. The cleaning subsystem that is typically used in current practice includes a rotating fur brush and an associated vacuum. The fur brush typically rotates at high speeds, and the vacuum induced high air velocity is required to clean the brush and transport the airborne marking particles and other contaminants to a filter.

Examples of selectively positionable roller transfer apparatus constructed to include integral cleaning mechanisms are shown in U.S. Pat. No. 5,101,238 (issued Mar. 31, 1992, in the names of Creveling et al), and U.S. Pat. No. 5,491,544 (issued Feb. 13, 1996, in the names of Kenin et al). While roller transfer apparatus with associated cleaning mechanisms of this type are generally effective in providing for reliable image transfer to receiver members and efficient transfer roller cleaning, under certain circumstances the transfer roller cleaning is insufficient. This is particularly the case when process control patches are developed in the interframe between marking particle images. Contamination is also picked up by the transfer roller from the dielectric support member splice. The cleaning mechanisms described in the aforementioned patents can be ineffective as presently configured to handle such process control patch contamination or dielectric support member splice contamination picked up by the transfer roller. Further, in discharge area development (DAD), the contamination problem may be accentuated (may be material dependent). This is due to the polarity of charge on residual marking particles, or marking particles in the interframe between images, urging the marking particles to the transfer roller to contaminate the roller.

Apparatus and methods for controlling the transfer roller bias to prevent contamination by excess marking particles are known in the art. For example, U.S. Pat. No. 6,014,158 (issued Jan. 11, 2000 in the names of Ziegelmuller et al) shows reversing the polarity of the transfer roller when interframe portions of the dielectric support member pass the transfer roller to substantially prevent attraction of marking particles from process control patches or from the dielectric support member splice. This approach is effective in preventing certain types of contamination. For instance, when negatively charged marking particles are used to develop an image, the transfer roller operates with a positive bias to transfer the image to a receiver. The transfer roller then switches polarity between receivers and the resulting negative bias on the transfer roller repels negatively charged marking particles from process control patches and from the dielectric support member splice. However, some reverse-charged marking particles typically are found among the normally charged particles. For instance, in an apparatus that uses negatively charged marking particles to develop images, a relatively small number of reverse-charged marking particles having a positive polarity may also be present. These positively charged marking particles are attracted to the transfer roller when it is negatively biased, and thereby cause contamination of the transfer roller and, in turn, receiver sheets. Contamination by reverse-charged marking particles is particularly common at the beginning of a reproduction job because reverse-charged marking particles are frequently dislodged from the developing station during start-up, as described more fully below.

It is therefore an object of the present invention to provide an electrostatographic reproduction apparatus and method that provides for a controlled start-up routine that substantially prevents contamination of the image transfer member by both normally charged and reverse-charged marking particles.

BRIEF SUMMARY OF THE PREFERRED EMBODIMENTS

In accordance with the present invention, an electrostatographic reproduction apparatus and method are described with an improved start-up process for substantially preventing contamination of the image transfer member by both normally charged and reverse-charged marking particles.

According to one aspect of the present invention, an electrostatographic reproduction apparatus is provided. The reproduction apparatus includes a transfer assembly with an electrically biased transfer roller in nip relation with a dielectric support member for effecting transfer of a pigmented marking particle image from an image area of the dielectric support member to a receiver member. The reproduction apparatus also includes a mechanism for preventing contamination of the transfer roller, including a control for the electrical bias on the transfer roller. The transfer roller bias control includes a power supply generating an electrical output at constant current or constant voltage of a settable polarity. The power supply is connected to the transfer roller for applying an electrical bias of a set polarity to the transfer roller. Means for disengaging the power supply during a start-up phase of reproduction are provided to prevent transfer of residual marking particles from the dielectric support member to the transfer roller.

According to another aspect of the present invention, a method is provided for preventing residual marking particle contamination of a transfer roller in an electrostatographic reproduction apparatus. The reproduction apparatus includes a dielectric support member supporting a pigmented marking particle image, and a power supply for selectively generating an electrical output at constant current or constant voltage of a settable polarity. The power supply is connected to the transfer roller for applying an electrical bias of a set polarity to the transfer roller. The power supply is disabled during a start-up phase of the electrostatographic reproduction apparatus so as to prevent transfer of residual marking particles from the dielectric support member to the transfer roller. The power supply is re-enabled to produce an electrical bias on the transfer roller to transfer the pigmented marking particle image from the dielectric support member to a receiver member.

The invention, and its objects and advantages, will become more apparent in the detailed description of the preferred embodiment presented below.

BRIEF DESCRIPTION OF THE DRAWINGS

The subsequent description of the preferred embodiments of the present invention refers to the attached drawings, wherein.

DETAILED DESCRIPTION OF THE PREFERRED EMBODIMENTS

The present invention is described below in the environment of a particular electrophotographic copier and/or printer, such as the Digimaster 9110, commercially available from Heidelberg Digital, L.L.C. of Rochester, N.Y. However, it will be noted that although this invention is suitable for use with such machines, it also can be used with other types of electrophotographic copiers and printers.

Because apparatus of the general type described herein are well-known, the present description will be directed in particular to elements forming part of, or cooperating more directly with, the present invention.

Figure 1:
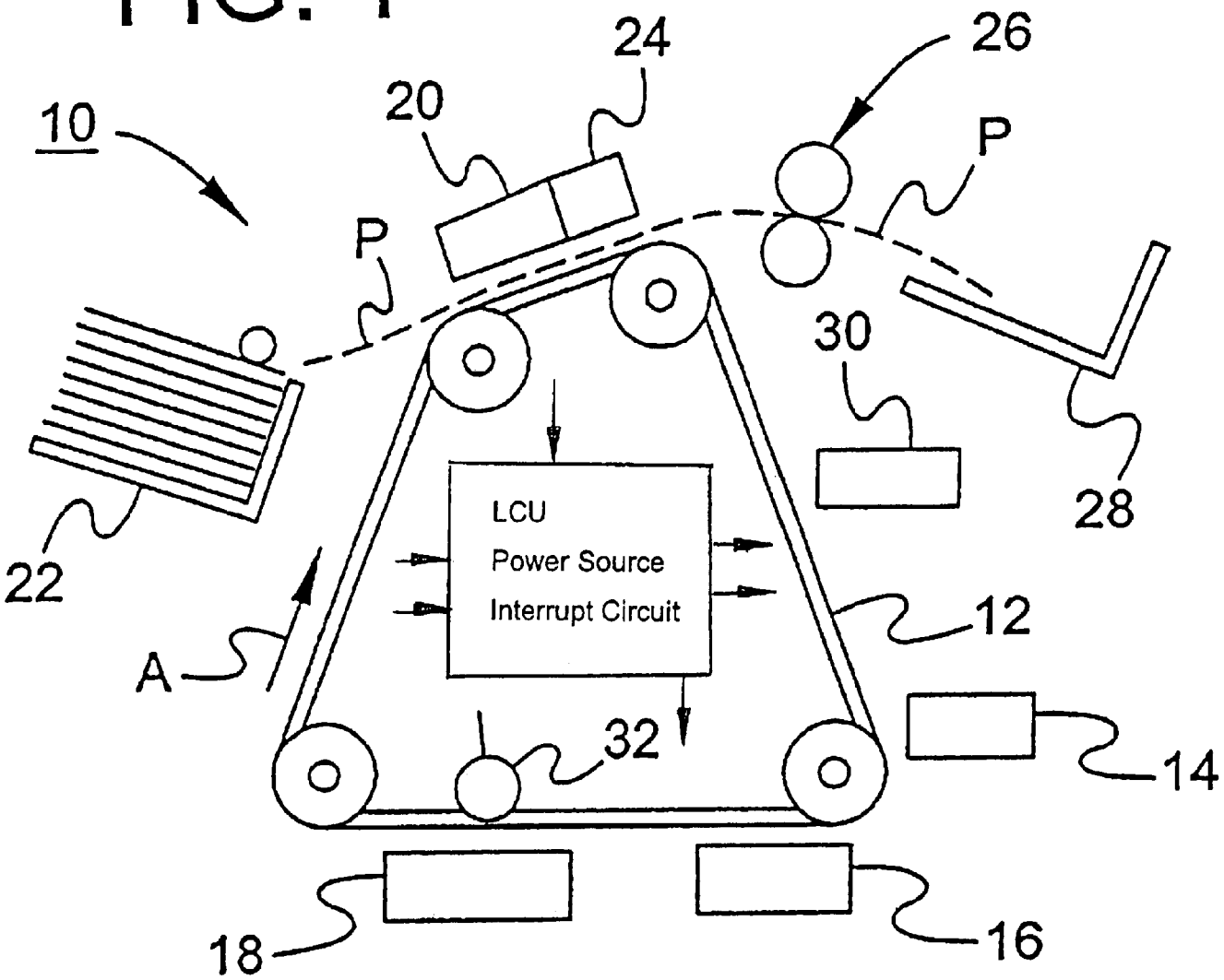
FIG. 1 shows a schematic diagram depicting an electrostatographic recording apparatus employing one presently preferred embodiment of the invention.

Referring now to the accompanying drawings, FIG. 1 schematically illustrates a typical electrostatographic reproduction apparatus 10 suitable for utilizing an exemplary roller transfer assembly (designated generally by the numeral 20), such as shown and described in aforementioned U.S. Pat. No. 5,491,544. The reproduction apparatus 10 and the roller transfer assembly 20 are described herein only to the extent necessary for a complete understanding of this invention. The electrostatographic reproduction apparatus 10 is under the control of a microprocessor-based logic and control unit LCU of any well known type. Based on appropriate input signals and programs supplied by software control algorithms associated with the microprocessor, the logic and control unit LCU provides signals for controlling the operation of the various functions of the reproduction apparatus for carrying out the reproduction process. The production of suitable programs for commercially available microprocessors is a conventional skill well understood in the art. The particular details of any such programs would, of course, depend upon the architecture of the designated microprocessor.

The reproduction apparatus 10 includes a dielectric support member 12, for example, in the form of an endless web mounted on support rollers and movable about a closed loop path in the direction of arrow A through a series of electrographic process stations. Of course, this invention is suitable for use with other dielectric support member configurations, such as drums for example. In the reproduction cycle for the reproduction apparatus 10, the moving dielectric support member 12 is uniformly charged as it moves past a charging station 14. Thereafter the uniformly charged dielectric support member passes through an exposure station 16 where the uniform charge is altered to form a latent image charge pattern corresponding to information desired to be reproduced. Depending upon the characteristics of the dielectric support member 12 and the overall reproduction system, formation of the latent image charge pattern may be accomplished by exposing the dielectric support member 12 to a reflected light image of an original document to be reproduced or "writing" on the dielectric support member 12 with a series of lamps (e.g., LED's or lasers) or point electrodes activated by electronically generated signals based on the desired information to be reproduced.

The latent image charge pattern on the dielectric support member 12 is then brought into association with a development station 18 which applies pigmented marking particles to adhere to the dielectric support member 12 to develop the latent image. A back-up assembly 32 engages the dielectric support member 12 during development and urges the dielectric support member 12 against the development station 18 so as to provide intimate uniform contact therebetween. The back-up assembly 32 is actuated so that it may be disengaged from the dielectric support member 12 when it is not needed for development of an image.

The portion of the dielectric support member 12 carrying the developed image then passes through a transfer station 20 in register with a receiver member fed in proper timed relation from a supply hopper 22 along the path P. An electric field produced in the transfer station 20 attracts the marking particles of the developed image from the dielectric support member 12 to the receiver member.

The electric transfer field may also cause the receiver member to adhere to the dielectric support member 12. Accordingly, a detack device 24, immediately downstream in the direction of travel of the dielectric support member 12, is provided to facilitate removal of the receiver member from the dielectric support member 12. The detack mechanism 24 may be, for example, an AC corona charger for reducing or neutralizing the attractive field holding the receiver member to the dielectric support member 12. After the developed image is transferred to the receiver member and the receiver member is separated from the dielectric support member 12, the receiver member is transported through a fusing device 26 where the image is fixed to the receiver member by heat and/or pressure for example, and delivered to an output hopper 28 for operator retrieval. Simultaneously, the dielectric support member 12 is cleaned of any residual marking particles at cleaning station 30 and returned to the charging station 14 for reuse.

Figure 2:
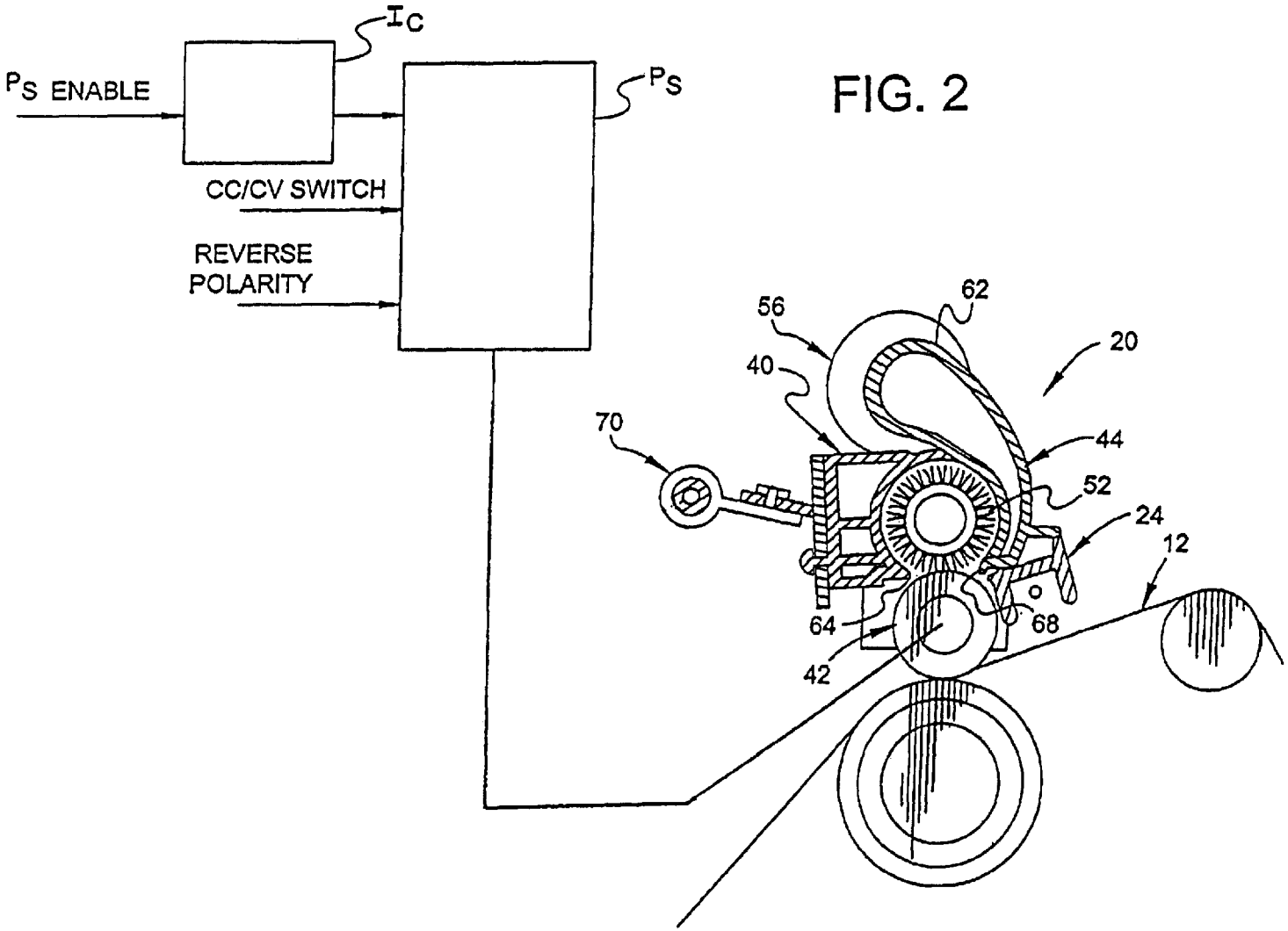
FIG. 2 shows a side elevational view, partly in cross-section and on an enlarged scale, the electrical biased transfer roller assembly of FIG. 1.
Figure 3:
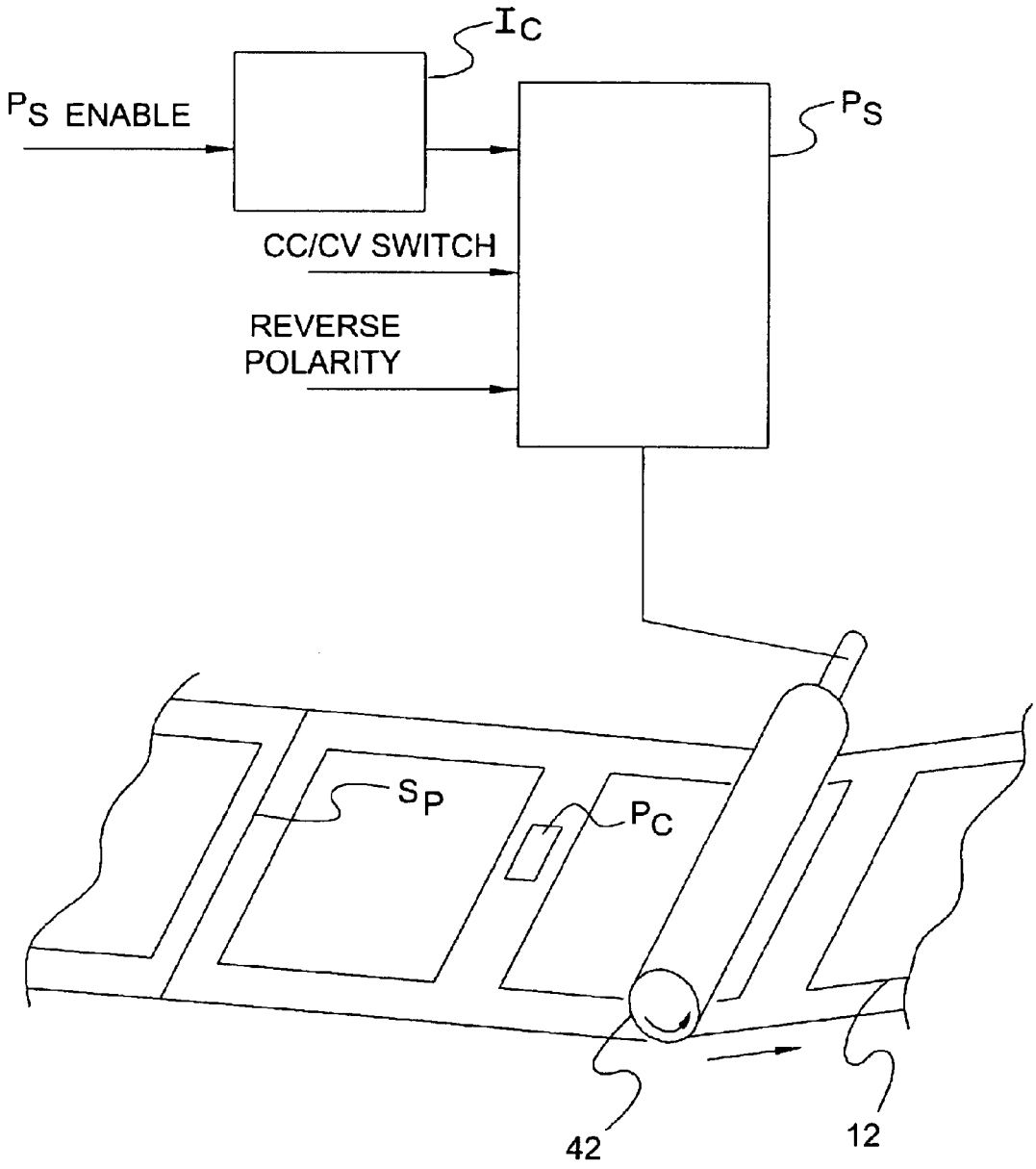
FIG. 3 shows a perspective view of the electrical biased transfer roller and photoconductive web of the reproduction apparatus of FIG. 1.

Turning now to the exemplary transfer station 20, as noted above such station is for example a roller transfer assembly which is described below with particular reference to FIG. 2 in sufficient detail for a complete understanding of this invention. Of course, other roller transfer assemblies are suitable for use with this invention. The roller transfer assembly includes a unitary housing 40 containing a transfer roller 42, a roller cleaning mechanism 44, and a detack device 24 in a compact configuration. An electrical bias is applied to the core of the roller 42 from a power supply $P_S$ (see FIG. 3) described in detail below. As such, when the transfer roller is in operative association with the dielectric support member 12 (as shown in FIG. 2), an electrical transfer field is established which will efficiently transfer a marking particle developed image from the dielectric support member 12 to a receiver member passing therebetween.

The detack device 24 of the roller transfer assembly is preferably an AC corona charger interconnected with the unitary housing 40. The detack device 24 is located such that when the roller transfer assembly 20 is in operative association with the dielectric support member 12, the detack charger is located downstream (in the direction of dielectric support member travel) from the transfer roller 42 to effectively provide a field which relieves the electrostatic attraction forces between the receiver member and the dielectric support member 12. In this manner, the receiver member is readily detacked from the dielectric support member 12 for transport along its intended path P to the fusing device 26 (FIG. 1) without interference or jamming. With the compact arrangement for the roller transfer assembly as described, a mounting is provided, designated generally by the numeral 70. The mounting 70 enables the roller transfer assembly to contact the dielectric support member 12 in a manner so as to impart no steering forces to the moving dielectric support member 12.

When the transfer roller 42 contacts the dielectric support member 12 with no receiver member therebetween, the transfer roller 42 tends to pick up residual marking particles from the dielectric support member 12. On passes of subsequent receiver members to accomplish developed image transfer, the marking particles on the transfer roller 42 can be deposited on the back side of the receiver members to form undesirable marks thereon. Accordingly, the transfer roller 42 must be efficiently and continuously cleaned. The cleaning mechanism 44 of the roller transfer assembly 20 includes an elongated, cylindrical, fiber brush 52. The brush 52 is supported in the unitary housing 40 such that the longitudinal axis of the brush is parallel to the longitudinal axis of the transfer roller 42. The respective longitudinal axes are spaced apart a distance such that a portion of the peripheral surface of the brush 52 contacts the transfer roller 42. A motor 56, attached to the unitary housing 40, is coupled to the brush 52 to rotate the brush at a high rate of speed and preferably in a direction such that, in the area of contact between the brush 52 and the transfer roller 42, the two are moving in opposite directions to effectively sweep marking particles (and any accumulated paper dust) from the transfer roller into the fibers of the brush.

In order to keep the fibers of the brush 52 from becoming overloaded with marking particles cleaned from the transfer roller 42, the cleaning mechanism 44 also includes a vacuum air flow system 62, in flow communication with a vacuum blower (not shown). The air flow system forms an air flow directing chamber about the brush 52. The air flow chamber provides an air flow passage wrapping about a portion of the brush 52 with an opening 64 to the brush located adjacent to the peripheral surface of the brush downstream (in the direction of rotation of the brush) from the area of contact between the brush and the transfer roller and extending in the direction of the longitudinal axis of the brush. A lip 68 extends into the fibers of the brush. As the brush 52 is rotated by the motor 56, the lip 68 acts as a flicker bar to bend the brush fibers and snap the fibers to facilitate release of particulate material therefrom. Such freed particulate material is entrapped in the air flow stream and transported away from the cleaning mechanism to a remote collection location (not shown).

As discussed above, an electrostatographic reproduction apparatus 10 using a contacting, electrical biased, semiconductive roller 42 for transferring marking particle developed images from the dielectric support member 12 to a receiver member, and using a marking particle developed patch in an interframe area for process control, can have problems with marking of the backside of a receiver member following the process control patch. The marking particles of the process control patch transfer to the transfer roller 42, and if all the marking particles are not cleaned off in one revolution, the residual marking particles can mark the back of a subsequent receiver member. To partially resolve this problem it is known in the art to use a reverse electrical bias (same charge polarity as the marking particles) on the transfer roller 42 when no receiver member is present in transfer relation between the dielectric support member 12 and the transfer roller 42.

For instance, in the discharged area development (DAD) mode of operation for the reproduction apparatus 10, the dielectric support member 12 is charged negatively, and the image developing marking particles are of negative polarity. In the discharged areas of the dielectric support member 12, such as over the interframes where the dielectric support member splice $S_P$ and process control patches $P_C$ are located (see FIG. 3), the dielectric support member voltage can be anywhere from −60 V to −500 V. The marking particles, being negative, will be weakly held by the dielectric support member 12, and will tend to move in the direction of a medium which is positive, such as the receiver member or the transfer roller surface. Proper transfer roller electrical bias is selected to prevent or minimize pick-up of contamination from the dielectric support member splice $S_P$ and process control patches $P_C$. To minimize marking particle pick-up from discharged areas of dielectric support member 12, the transfer roller electrical bias is set to be in a range of about −250 V to −1000 V. The use of reverse electrical bias on the transfer roller 42 serves to generate an electric field that will prevent transfer (i.e., repel, or drive, negative marking particles so that they remain on the dielectric support member 12), and thus reduce transfer roller contamination.

Reversing the electrical bias on the transfer roller 42 markedly reduces the amount of normally charged marking particles transferred to the roller 42 and therefore prevents some backside marking. However, some reverse-charged marking particles typically are present in the reproduction apparatus 10. In the DAD mode of operation, in which normal marking particles are negative in polarity, reverse-charged marking particles are positive in polarity. These positively charged particles also contaminate the transfer roller 42 and cause undesired markings on the backside of a receiver.

Contamination due to reverse-charged marking particles is frequently observed at the beginning of a reproduction job. Markings caused by contamination of the transfer roller 42 then appear on the backside of the first receiver sheet processed in the job. It is believed that these positively-charged particles are dislodged during the start-up process that occurs at the beginning of a reproduction job. Before a job begins, the back-up assembly 32 is typically in a disengaged position, separated from the dielectric support member 12. During start-up, before the first image exposed on the dielectric support member 12 reaches the developing station 18, the back-up assembly 32 moves toward the dielectric support member 12 until it engages the support member 12, urging it against the developing station 18. The movement of the back-up assembly 32 causes a movement of air past and into the developing station 18. This movement of air can dislodge marking particles from the developing station 18. Some of these dislodged marking particles are carried away by the dielectric support member 12 as it moves past the developing station 18.

According to known methods, the transfer roller 42 is reverse-biased during start-up to avoid contamination by normally charged residual marking particles. However, in the case of reverse-charged marking particles, the use of reverse electrical bias on the transfer roller 42 achieves a result opposite of that intended. Instead of repelling these residual positively-charged marking particles, the reverse-biased transfer roller 42 attracts them, leading to increased transfer roller contamination. This roller contamination is forced to the backside of the receiver when the transfer roller bias is switched back to positive.

Therefore, according to the present invention, to prevent contamination of the transfer roller 42 with reverse-charged marking particles, the transfer power source $P_S$ is disabled for a period of time during start-up. During this time, the electrical potential on the transfer roller 42 is reduced to approximately zero volts. At this approximately neutral potential, the transfer roller 42 attracts very few marking particles, whether of positive or negative polarity, from the dielectric support member 12. Accordingly, disengaging the transfer power source $P_S$ and reducing the bias of the transfer roller 42 to approximately zero volts during start-up substantially prevents contamination of the transfer roller 42 with normally charged marking particles without attracting reverse-charged marking particles to the transfer roller 42. Reducing the bias to approximately zero volts allows for improved cleaning of the positive charged marking particles.

In high speed electrostatographic reproduction apparatus, the time available to switch from the running electrical bias on the transfer roller to the reverse electrical bias is very short. To accomplish the switching in the time available, the power supply $P_S$ preferably should be running in the constant voltage mode. However, for most efficient marking particle transfer, it is more common during image transfer for the power supply $P_S$ to be running in the constant current mode. Therefore, the power supply $P_S$ may be provided with the ability to switch between the constant current and constant voltage mode of operation, to switch polarities, and to "lock in" the voltage it was running at in constant current mode in order to switch back to such voltage after running in the constant voltage mode.

According to one embodiment of this invention, an interrupt circuit $I_C$ is provided between the logic control unit L and the power source $P_S$. The interrupt circuit $I_C$ is operable to interrupt the power source enable signal provided by the logic control unit L. When the interrupt circuit $I_C$ interrupts the power supply enable signal, the electrical bias of the transfer roller 42 is reduced to approximately zero volts.

Figure 4:
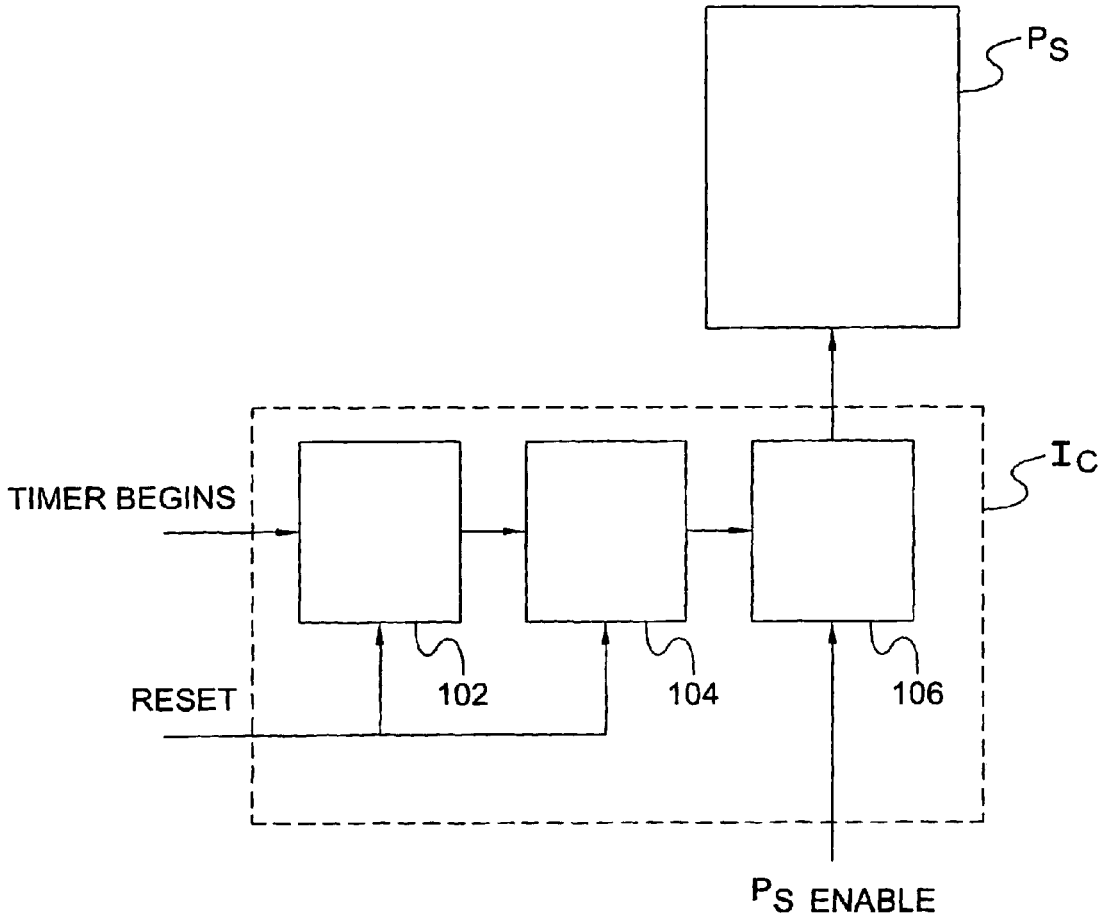
FIG. 4 shows a block diagram illustrating an exemplary transfer power supply interrupt circuit according one embodiment of the present invention.

FIG. 4 shows a block diagram illustrating in more detail an exemplary interrupt circuit $I_C$. The circuit $I_C$ includes a timer 102, such as a one shot circuit, a latch 104, and a relay switch 106. The relay switch 106 receives the power source enable signal from the logic control unit LCU. When the relay switch 106 is turned on, the power source enable signal is passed to the power source $P_S$, which in turn is enabled and controls the electrical bias of the transfer roller 42 as described above. When the relay switch is turned off, the power source enable signal is interrupted, the power source $P_S$ is disabled, and the transfer roller bias is reduced to approximately zero volts.

The relay switch 106 is turned on and off by the timer 102 and the latch 104. The timer 102 and the latch 104 are responsive to a reset signal, which causes the output signals of both the timer 102 and the latch 104 to go low. When the output signal of the latch 104 goes low, the relay switch 106 is turned off, and the power source enable signal is interrupted. The timer 102 also is responsive to a timer begin signal. A predetermined period of time after receiving the timer begin signal, the output signal of the timer 102 goes high. The latch 104 receives the high output signal from the timer 102, which causes the output signal of the latch 104 to go high. When the relay switch 106 receives a high output from the latch 104, the relay switch 106 turns on, thereby passing the power switch enable signal to the power source $P_S$, which enables the power source. Thus, using the reset and timer begin signals, the interrupt circuit is operative to disable and enable the transfer power source $P_S$, as described more fully below. The interrupt circuit $I_C$ shown in FIG. 4 is merely exemplary. It will be understood in the art that other circuits may be constructed to perform the same logical operations. The functions of the interrupt circuit $I_C$ also may be implemented using a software program executed on a microprocessor. The production of suitable programs for commercially available microprocessors is a conventional skill well understood in the art. The particular details of any such programs would, of course, depend upon the architecture of the designed microprocessor.

Depending upon the particular mechanical configuration of the electrostatographic reproduction apparatus 10, various timing signals may be used to interrupt and restore the power source enable signal. For instance, the reset signal (FIG. 4) may be provided by a main drive initialize signal that is produced by the logic and control unit LCU at the beginning of start-up. This ensures that the transfer power source $P_S$ is disabled, and the transfer roller bias is reduced to approximately zero volts, from the beginning of the start-up phase.

Alternatively, a back-up engage signal provided by the logic and control unit LCU to engage the back-up assembly 32 during start-up may be used to provide the reset signal. This signal is produced after the main drive initialization signal, but before the first image of the reproduction job is developed at the developing station. Use of the back-up engage signal to provide the reset signal causes the neutralization of the transfer roller bias to coincide with engagement of the back-up assembly, which is what dislodges the reverse-charged marking particles from the developing station. By the time these marking particles travel with the dielectric support member 12 to the transfer station 20, the transfer roller 42 will be reduced to approximately zero volts, thereby preventing transfer of these particles from the dielectric support member 12 to the transfer roller 42.

For the transfer roller 42 to return to normal reproduction operation after start-up, the transfer power source $P_S$ must be re-enabled. According to one embodiment of the invention, re-enablement of the power source $P_S$ is triggered by a transport sensor signal, which indicates that the first receiver is approaching the transfer station 20. The transport sensor signal is produced by an electrical or optical sensor upstream in the transport path P from the transfer station 20. The transport sensor detects the leading edge of the receiver as it moves toward the transfer station 20, and produces the transport sensor signal. This signal may be used to begin the timer 102. The timer is designed or programmed to produce a high output signal a predetermined time later. The predetermined time is selected to ensure that the power source $P_S$ is re-enabled, and normal transfer roller bias control is resumed, before the first receiver reaches the transfer station 20. For example, the predetermined time may be approximately 400 milliseconds.

Figure 5:
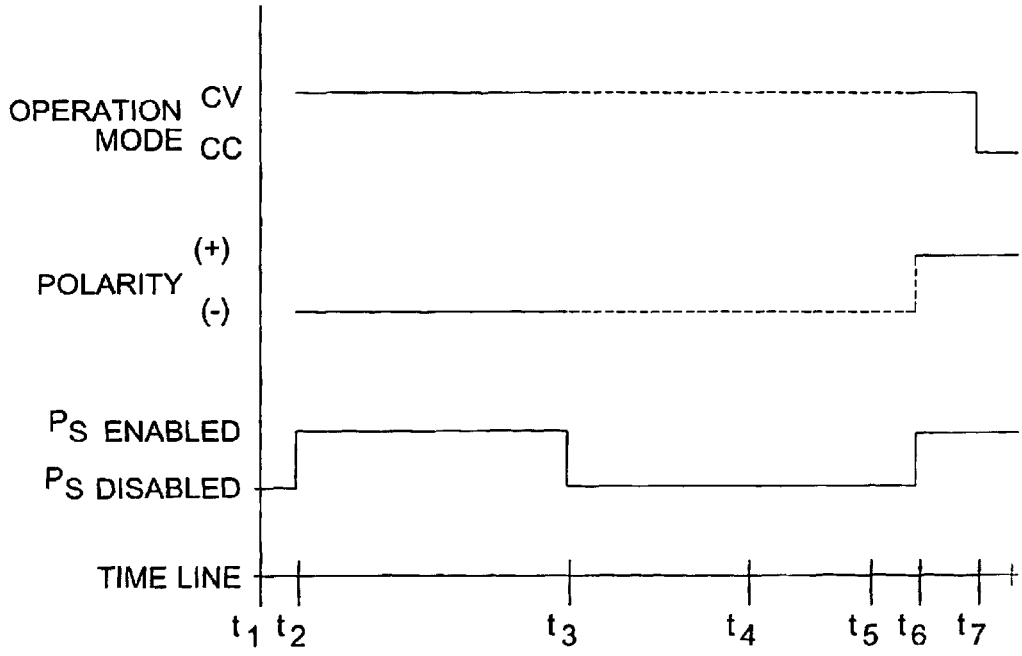
FIG. 5 shows a timing diagram of the start-up process according to another embodiment of the present invention.

A timeline of the start-up process according to one embodiment of the present invention is shown in FIG. 5. The timeline shows, for times $t_1$ to $t_6$, whether the transfer power source $P_S$ is enabled or disabled, the power source operation mode (constant voltage or constant current), and polarity of the transfer roller bias. At time $t_1$, the start-up process begins. Shortly thereafter, at time $t_2$, the main drive is initialized and, among other things, the transfer power source $P_S$ is enabled. At this time, the power source $P_S$ is operating in constant voltage mode and producing a negative bias on the transfer roller 42. At time $t_3$, the back-up assembly 32 is engaged. In response to the back-up assembly engage signal, the power source $P_S$ is disabled by interrupting the power source enable signal. Dotted lines showing the power source operation mode and polarity between times $t_3$ and $t_6$ indicate that the power source is disabled during this time. At time $t_4$, the reproduction apparatus 10 begins to write the first image at the exposure station 16. At time $t_5$, the transport sensor detects the lead edge of the first receiver member and produces a transport sensor signal. In response to the transport sensor signal, a timer begins to count down a predetermined time until the transfer power source $P_S$ will be re-enabled.

The reproduction apparatus 10 transitions from start-up mode to normal reproduction mode at time $t_6$, when the lead edge of the first receiver reaches the transfer station 20 in register with the first developed image on the dielectric support member 12. At this time, or shortly before this time, the power source $P_S$ is re-enabled to produce a positive electrical bias on the transfer roller 42 to transfer the negatively charged marking particles of the developed image from the dielectric support member 12 to the receiver member. For example, the power source $P_S$ may be re-enabled approximately 100 milliseconds before the lead edge of the first receiver reaches the transfer station 20. After it is re-enabled, the power source $P_S$ continues to operate in constant voltage mode for a short time to allow the capacitive current to settle out. Then, at time $t_7$, the power source $P_S$ switches to constant current mode.

The invention has been described in detail with particular reference to preferred embodiment thereof, but it will be understood that variations and modifications can be effected within the spirit and scope of the invention as set forth in the claims.

What is claimed is:

1. An electrostatographic apparatus for producing images on a receiver member comprising:

a negatively charged dielectric support member;

a development station containing negatively and positively charged marking particles;

a back-up for urging the dielectric support member against the development station when engaged;

a transfer roller;

a power supply to electrically bias the transfer roller positive to cause the transfer of marking particles from the dielectric support member to the receiver member;

a controller to: i) disengage the back-up when the development station is not needed prior to a start-up phase of the apparatus; ii) engage the back-up during the start-up phase; iii) disable the power supply during the start-up phase to reduce the transfer roller bias to approximately zero volts to thereby prevent contamination of the transfer roller from positively charged marking particles; and iv) enable the power supply to electrically bias the transfer roller positive prior to a first receiver member reaching the transfer roller after the start-up phase by first operating in a constant voltage mode for a short time to allow capacitive current to settle out and then switch to a constant current mode.

2. An electrostatographic apparatus in accordance with claim 1, wherein disabling of the power supply coincides with engagement of the back-up.

3. An electrostatographic apparatus in accordance with claim 1, wherein the power supply is controlled by electric signals representative of the engagement and disengagement of the back-up.

4. A method of operating an electrostatographic apparatus for producing images on a receiver member comprising the steps of:

providing a negatively charged dielectric support member;

providing negatively and positively charged marking particles in a development station;

urging the dielectric support member against the development station by engaging a back-up;

electrically biasing a transfer roller positive to cause the transfer of marking particles from the dielectric support member to the receiver member;

disengaging the back-up when the development station is not needed prior to a start-up phase of the apparatus;

engaging the back-up during the start-up phase of the apparatus;

reducing the transfer roller bias to approximately zero volts during the start-up phase of the apparatus to thereby prevent contamination of the transfer roller from positively charged marking particles on the dielectric support member; and electrically biasing the transfer roller positive prior to a first receiver member reaching the transfer roller after the start-up phase by first operating in a constant voltage mode for a short time to allow capacitive current to settle out and then switch to a constant current mode.

5. A method in accordance with claim 4, wherein disabling of the power supply coincides with engaging the back-up.

6. A method in accordance with claim 4, wherein electrically biasing the transfer roller is dependent at least in part on engaging and disengaging the back-up.

7. A method of decontaminating a transfer roller in an electrostatographic reproduction apparatus for producing images on a receiver member comprising:

providing toner in a development station having negatively charged and positively charged particles;

supporting the particles on a negatively charged dielectric support member;

controlling a power supply to apply a positive electrical bias to the transfer roller to cause the transfer of marking particles from the dielectric support member to the receiver member;

disabling the power supply during a start-up phase of the electrostatographic reproduction apparatus so as to prevent transfer of positively charged residual marking particles from the dielectric support member to the transfer roller; and re-enabling the power supply after the startup phase, wherein re-enabling comprises operating the power supply in constant voltage mode for a short time to allow capacitive current to settle out and then switching the power supply to constant current mode.

8. A method in accordance with claim 7, further comprising the steps of:

engaging a back-up to urge the dielectric support member to the development station during normal operation;

disengaging the back-up to remove the dielectric support member away from the development station during the start-up phase; and, disabling and re-enabling the power supply in dependence on the engaging and disengaging status of the back-up.

* * * * *